US009452469B2

(12) United States Patent
Longa et al.

(10) Patent No.: US 9,452,469 B2
(45) Date of Patent: Sep. 27, 2016

(54) METHOD FOR THE PRODUCTION OF A HOLLOW METAL PART BY MEANS OF CASTING

(71) Applicant: Centre Techniques Des Industries De La Fonderie (C.T.I.F.), Sevres (FR)

(72) Inventors: Yves Longa, Jouy le Moutier (FR); Jean De Ruffray, Le Poinconnet (FR)

(73) Assignee: Centre Technique Des Industries De La Fonderie (C.T.I.F.), Sevres (FR)

( * ) Notice: Subject to any disclaimer, the term of this patent is extended or adjusted under 35 U.S.C. 154(b) by 0 days.

(21) Appl. No.: 14/394,715

(22) PCT Filed: Apr. 11, 2013

(86) PCT No.: PCT/FR2013/050792
§ 371 (c)(1),
(2) Date: Oct. 15, 2014

(87) PCT Pub. No.: WO2013/156713
PCT Pub. Date: Oct. 24, 2013

(65) Prior Publication Data

US 2015/0083356 A1 Mar. 26, 2015

(30) Foreign Application Priority Data

Apr. 16, 2012 (FR) ..... 12 53486

(51) Int. Cl.

| | |
|---|---|
| ***B22D 17/00*** | (2006.01) |
| ***B22C 7/06*** | (2006.01) |
| ***B22C 9/10*** | (2006.01) |
| ***B22D 29/00*** | (2006.01) |
| ***B22C 21/14*** | (2006.01) |
| ***B22D 17/20*** | (2006.01) |
| *B22D 17/14* | (2006.01) |

(52) U.S. Cl.
CPC ..... *B22D 17/00* (2013.01); *B22C 7/06* (2013.01); *B22C 9/10* (2013.01); *B22C 9/106* (2013.01); *B22C 21/14* (2013.01); *B22D 17/20* (2013.01); *B22D 29/001* (2013.01); *B22D 17/14* (2013.01)

(58) Field of Classification Search
None
See application file for complete search history.

(56) References Cited

U.S. PATENT DOCUMENTS

| | | | | |
|---|---|---|---|---|
| 1,422,232 | A * | 7/1922 | Stanley, Sr. | 164/370 |
| 2,752,652 | A * | 7/1956 | Hurley | 164/23 |
| 4,298,051 | A * | 11/1981 | Page | 164/72 |
| 2009/0183852 | A1* | 7/2009 | Bassi | 164/526 |

FOREIGN PATENT DOCUMENTS

| | | |
|---|---|---|
| DE | 2505093 | 8/1976 |
| EP | 0256609 | 2/1988 |
| EP | 1170496 | 1/2002 |
| JP | 02280944 | 11/1990 |

* cited by examiner

*Primary Examiner* — Kevin E Yoon
*Assistant Examiner* — Jacky Yuen
(74) *Attorney, Agent, or Firm* — Lee & Hayes, PLLC

(57) ABSTRACT

A method for producing a hollow metal part by casting, wherein a destructible core (20) is provided including a body (22) made of aggregate, and a shell (40) which surrounds the body and adheres thereto; the core (20) is positioned inside a mold (50); metal is melted and the liquid metal is injected, generally under pressure, into the mold (50), surrounding the core (20) embodying an interior space of the part; after solidification of the part, the body is disaggregated and it is removed through removal openings provided in the shell and the part; and the shell is destroyed and removed through removal openings provided in the part.

11 Claims, 3 Drawing Sheets

METHOD FOR THE PRODUCTION OF A HOLLOW METAL PART BY MEANS OF CASTING

FIELD OF THE INVENTION

The present disclosure relates to a method for producing a hollow metal part by casting and, more particularly, by die-casting.

Such a method is particularly useful in producing parts which exhibit a hollow interior and which consequently cannot be directly stripped off, such as for example a fluid-carrying pipe or a semi-closed container (e.g. a casing).

STATE OF THE PRIOR ART

Casting encompasses the forming processes for metals (i.e. pure metals and alloys) which consist of pouring a liquid metal into a mold to created, after cooling, a given part, while limiting to the extent possible subsequent finishing work on said part.

In the die-casting technique, the liquid metal is injected into the mold under a significant injection pressure, typically comprised between 100 and 1200 bars (i.e. 10 and 120 MPa). The speed of injection into the mold is typically comprised between 10 m/s and 80 m/s and the temperature of the liquid metal is typically comprised between 400 and 980° C.

In foundry work, die-casting is often reserved for mass production for markets such as automobiles or domestic appliances, due to the high cost of tooling (molds and cutting tools).

At present, to pressure cast a hollow part such as a pipe or a semi-closed vessel, the foundryman casts two half-parts which are later mechanically assembled by welding or gluing. This solution is unsatisfactory because, on the one hand, it requires two sets of casting tools (one for each half-part) and, on the other hand, the assembly step is critical due to the fluid-tightness required in the assembly zone.

Thus there exists a need for another production method.

PRESENTATION OF THE INVENTION

The present disclosure relates to a method for producing a hollow metal part by casting, wherein:

- a destructible core is provided including a body made of aggregates, and a shell which surrounds said body and adheres thereto;
- the core is placed inside a mold;
- the metal is melted and the liquid metal is injected into the mold, surrounding the core, the core forming an inner space in the part;
- after solidification of the part, the body of the core is disaggregated and removed through outlets provided in the shell and in the part; and
- said shell is destroyed and removed through outlets provided in the part.

The core used here differs from conventional cores used in gravity casting by the fact that it exhibits a shell that allows it to resist mechanically the forces exerted by the liquid metal during injection. Without this shell, the core would disaggregate under the influence of said forces. The shell adheres to the body of the core so as to avoid separation of the shell and the body during injection, and as the shell is supported by the core, the latter takes on a portion of the forces during injection.

Such a production method is particularly useful in die-casting, because the forces exerted by the liquid metal during injection are high and the shell of the core thus displays its full advantage. In this case, the mechanical strength of the shell is sufficient for resisting injection under pressure of the liquid metal and, during casting, the liquid metal is injected under pressure into the mold, surrounding the core.

Nevertheless, this production method could be used in casting in other applications such as low die-casting or gravity casting (e.g. for ferrous alloys and non-ferrous alloys, in metal or non-metallic molds).

The selection of the material constituting the shell is accomplished on the basis of the good mechanical strength of this material and of its good adhesion to the core. Some examples of materials are given hereafter, but a person skilled in the art could easily, considering the present disclosure, consider others.

Advantageously, the material constituting the shell also exhibits one or more of the following properties:

- it is chemically passive with respect to the injected metal, and in particular it does not dissolve therein;
- it is non-penetrable by the metal injected under pressure;
- it exhibits a good surface state, and in particular little or no surface porosity. This makes it possible to more easily detach the shell from the cast part and to obtain a good surface condition on the walls of the internal space of the part.

The shell of the core is made, for example, based on particles aggregated by a binder or binders of an organic (e.g. polyurethane), mineral (e.g. silicate, colloidal silica, ethyl silicate, low-melting-point metals) or hydraulic (e.g. plaster, cement, lime) nature. The particles can be ceramic, calcined clay, with or without zircon. They can result from the recycling of an old shell. According to another example, the shell is metallic.

The body of the core is for example made of foundry sand or casting plaster, possibly with a fiber filler. The binder used to aggregate the core materials can be hydraulic, organic (e.g. cellulose), or inorganic (e.g. silicate). The filler fibers can be of an organic or mineral nature (e.g. flax, wood, glass).

To disaggregate the body and remove the cast part, it is possible to use a conventional core-removal process, either mechanical (e.g. by impact, vibration, granule blasting or ultrasonic) and/or hydraulic (by water jet), or even a chemical core-removal method (e.g. by dissolving the binder(s)).

In certain embodiments, the destructible core includes, additionally, a framework which runs through the body of the core and is connected to the shell. This framework can be destroyed and removed at the same time as the body and/or the shell. Such a framework allows further reinforcement of the mechanical strength of the core.

In certain embodiments, to produce the core, the body of the core is made by aggregating materials in a box provided with pins passing through the interior of the box, such that the body, once extracted from the box, exhibits holes where the pins were, and these holes are vided with material constituting the framework, for example by dipping the body of the core in a slurry, by injecting (under low pressure) the same slurry or by pouring the slurry by gravity into a container.

The holes and the corresponding framework elements (i.e. the framework elements obtained by filling the holes with the material constituting the framework) can pass entirely, or only partially, through the body of the core.

In certain embodiments, the body of the core is dipped one or more times in one or more slurries, so as to cover the body with one or more layers of a hardenable material. For example, plaster can be used as a slurry. For example, the body of the core can be dipped in a first slurry to form the framework, if any, and the lower layer of the shell, and then in other slurries to form the upper layer(s) of the shell. Thus the body of the core can be dipped in a first slurry to form the framework and a lower layer of the shell and then in one or more other slurries to form one or more upper layers of the shell. Instead of dipping, it is possible to make the shell by injection of the slurry.

The materials constituting the shell and the framework can be identical or different. What is more, the criteria that can be used for the materials of the shell and the framework do not necessarily match. In particular, as the framework does not come into contact with the injected metal, its chemical passivity with respect to this metal is not a selection criterion. In addition, as the framework is subjected to smaller forces than the shell during injection, the mechanical strength of the framework can be less high than that of the shell. Moreover, in certain embodiments, it is desired to remove the framework at the same time as the body. In this case, like the body, the framework is made of aggregated materials which can be disaggregated. Thus it is possible to disaggregate and remove the body and the framework, in a single operation, in a core-removal process.

In certain embodiments, to produce the core:

the body of the core is fabricated by aggregating materials in a box provided with support members passing (all the way or partway) through the interior of the box, et the shell surrounding the core and the support members is made, such that the support members run through the shell.

The support members are then used to hold the core in position during injection. Depending on the position occupied by the support members in the core, these can also serve to increase the mechanical strength of the core.

In certain embodiments, the support members are hollow and define passages for exhausting the gases which are formed by the thermal decomposition of certain components of the core during casting of the part. This makes it possible to limit the risks of distortion connected with these gases, particularly when the part exhibits thin walls.

In certain embodiments the support members of the part are extracted to provide the removal passages through which the body of the core and/or the shell are removed.

Other features and advantages of the proposed method will appear upon reading the detailed description that follows. This detailed description makes reference to the appended drawings.

BRIEF DESCRIPTION OF THE DRAWINGS

The appended drawings are schematic and are not to scale; they aim primarily to illustrate the principles of the invention.

In these drawings, from one figure (FIG) to another, identical elements (or parts of elements) are labeled with the same reference symbols.

DETAILED DESCRIPTION OF EXEMPLARY EMBODIMENT(S)

An example method is described hereafter in detail, with reference to the appended drawings. This example illustrates the features and advantages of the invention. It is recalled, however, that the invention is not limited to this example.

Figure 1:
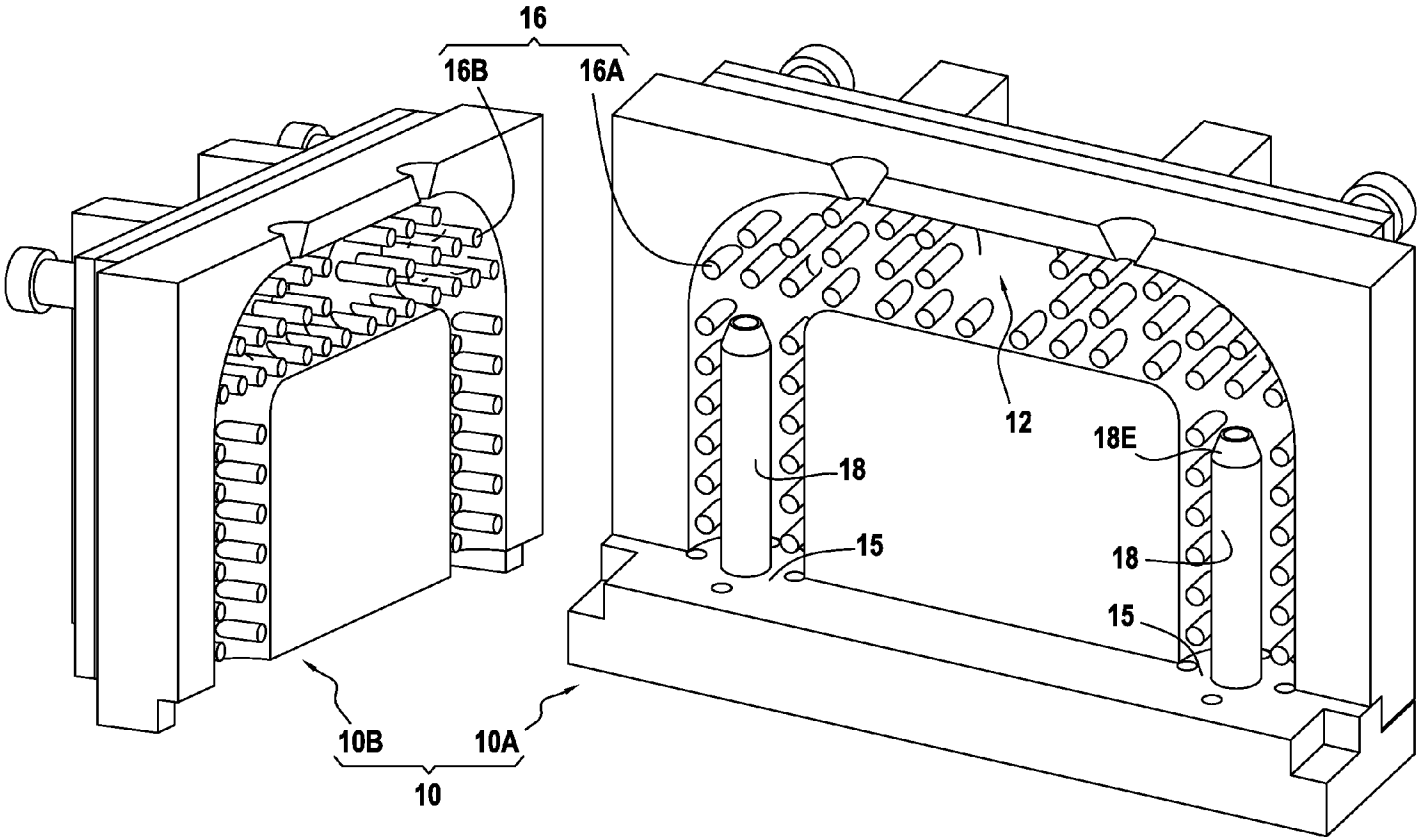
FIG. 1 shows a box for fabricating the body of a core.

FIG. 1 shows a box 10 for fabricating the body 22 of a core 20. This box includes two half-shells 10A, 10B which, when assembled, define between them an open space 12 intended to accommodate the materials which will form the body of the core.

Pins 16 extend inside the box, i.e. in the open space 12. In the example, these pins 16 pass all the way through the open space 12, each pin 16 consisting of two half-pins 16A, 16B carried, respectively, by the two half-shells 10A, 10B and located so that each is an extension of the other once the half-shells are assembled.

Inside the box are also found support members 18 which run partway through the free space 12. In the example, these members 18 are hollow and of tubular shape with a tapered (frusto-conical) free end 18E. The other end of these members 18 is supported on one of the walls 15. Each member 18 has an internal passage (an orifice) running through it, opening at both ends of the member.

To manufacture the body 22 of the core, the open space 12 is filled with aggregates, grains of sand for example, mixed with at least one hardenable resin. Once the resin(s) is (are) hardened (e.g. by heating, or by using a catalyst gas), the sand grains are aggregated and form the body 22. The body 22 is then extracted from the mold 10.

Figure 2:
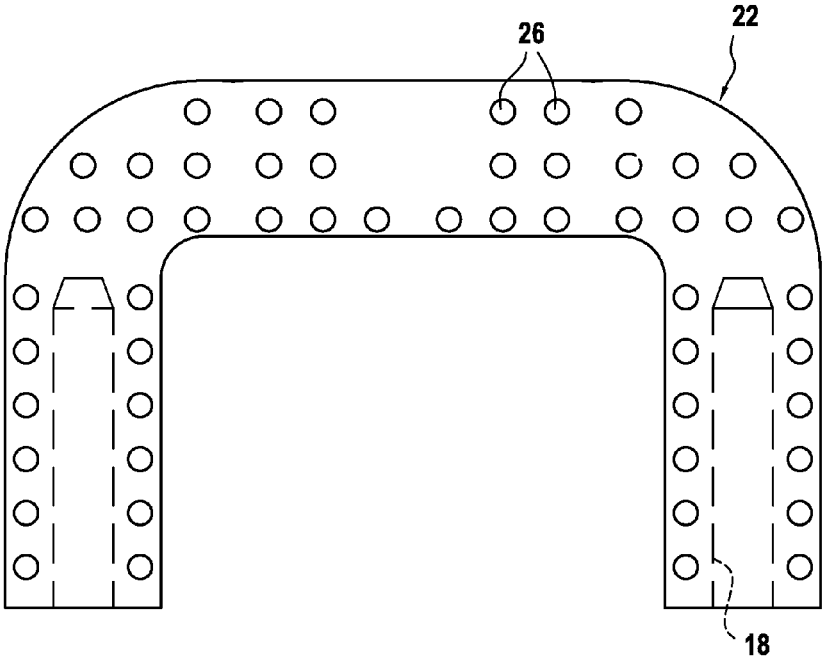
FIG. 2 is a side view of the body of the core fabricated using the box of FIG. 1.

As shown in FIG. 2, the body 22 has holes 26 in place of the pins 16. In addition, the support members 18 are imprisoned in the mass of the body 22.

To produce the core 20, the body 22 is dipped, one or more times, into one or more baths of fluid paste, or slurries, so as to cover the body with one or more layers of a hardenable material. To hold the body 22 during dipping, hollow support members 18 are used. Typically, pins are run through the inside of the members 18, which makes it possible to hold the body 22 and to plug the inner passage of the members 18 to prevent them from being filled. After each dip, the deposited layer is hardened, in air for example.

During the first dipping into a first slurry, the holes 26 in the body 22 fill to form a framework 36. The framework 36 thus consists of several elements which pass through the body 22 of the core, and are connected to the shell 40. In the example, similarly to the holes 26, the framework elements pass all the way through the body, so that both ends of each framework element are connected to the shell 40.

The first slurry also forms the first layer, or lower layer, of the shell 40. The other layers, if any, of the shell 40 can be obtained by dipping the body 22 into other baths of hardenable materials.

To cover the body 22 and fill the holes 26, instead of (or in addition to) dipping operations it is possible to proceed with injection or gravity pouring of a slurry around and/or into the body.

Figure 3:
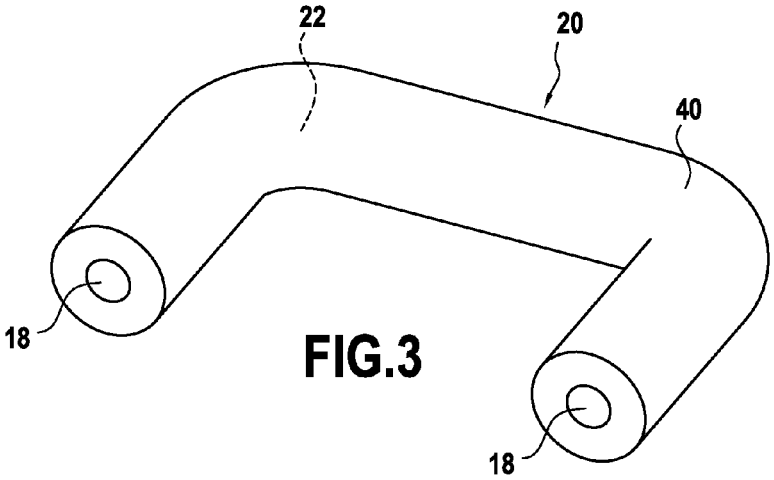
FIG. 3 is a perspective view of the core produced with the body of FIG. 2.

FIG. 3 shows the core 20 obtained after formation of the shell 40 surrounding the body 22.

By way of an example, it is possible to fabricate the core 20 from the following materials and under the following conditions: to fabricate the body 22, foundry sand precoated with resin and hardener is used, and the resin is hardened using its hardener. For example, the sand used is AFS 55 grade silica. The fineness of the sand can change depending on the shape and the size of the core to be used. The body 22 obtained is then dipped in a refractory slurry mixed with colloidal silica. During the first dipping, the holes 26 are filled with slurry to form the framework. The body 22 is dried and then dipped again in the slurry as many times as necessary to obtain the desired thickness of the shell 40 after the final drying.

Figure 4:
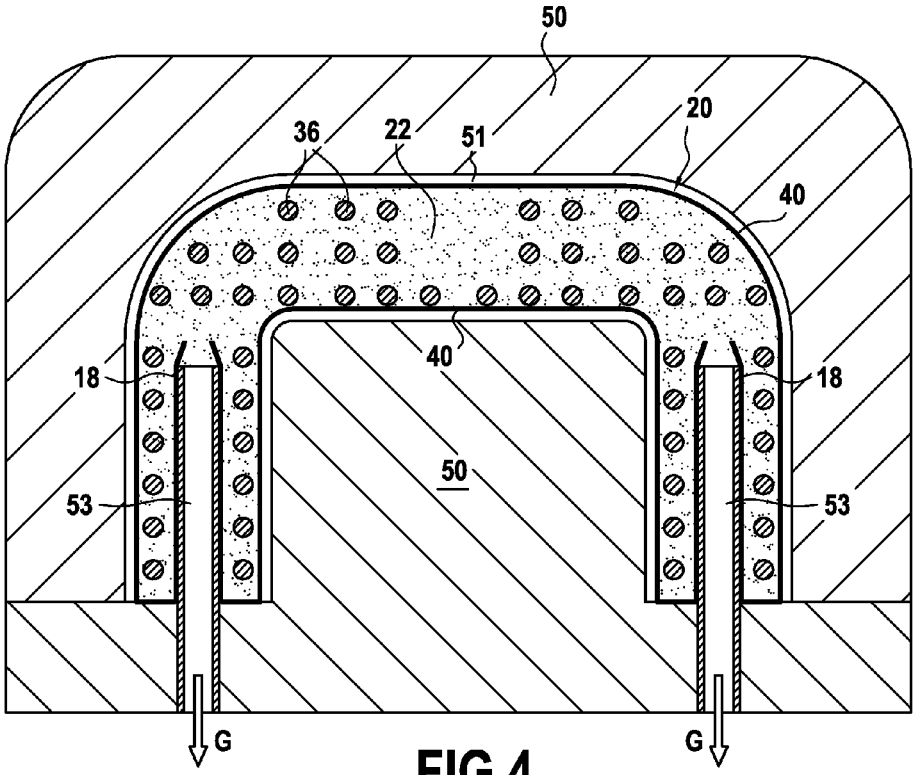
FIG. 4 is a sectional view of a mold wherein is positioned the core of FIG. 3.

Once the core 20 is produced, it is positioned in the print 51 of a mold 50, as illustrated in FIG. 4. This figure shows the mold 50 and the core 20 in section. The core 20 is held in position in the mold 50 by means of hollow pins 53, fastened to a portion of the mold 50, and inserted into the support members 18 of the core 20.

The metal is then melted and the liquid metal is injected into the mold, surrounding the core 20. The injection of the metal can be accomplished under pressure, the shell 40 resisting the forces exerted during injection and allowing the core 20 to maintain its integrity. In addition, the gases connected with the thermal decomposition of certain elements (typically the binders) constituting the core 20 are advantageously exhausted to the outside of the mold 50, via the interior passages of the support members 18 and of the pins 53. This exhausting is symbolized by the arrows G in FIG. 4.

After hardening and cooling (total or partial) of the metal, a metal part 60 which surrounds the core 20 is extracted from the mold 50, the core 20 embodying the hollow space inside this part. To separate the core 20 from the part 60, this is subjected to a conventional core-removal process, typically mechanical and/or hydraulic. The body 22 of the core disaggregates under the combined influence of thermal decomposition of the binders which constituted it (this decomposition occurring during injection of the liquid metal under the influence of the temperature of said metal) and of the core-removal forces. If its composition allows, the framework 36 can also break up at the same time as the body 22. If not, the framework 36 can be extracted after the body 22, for example by subjecting the part to a second core-removal process. In the example, the elements resulting from the disaggregation of the body 22, and of the framework 36 if any, are removed through the end openings 62 of the hollow tubular part 60. The support members 18 are extracted at the same time as the body 22 by these openings 62. It will be noted that these openings 62 run through the part 60 and the shell 40. According to another example, not shown, the exhaust openings are provided by extracting the support members 18 out of the core 20.

Figure 5:
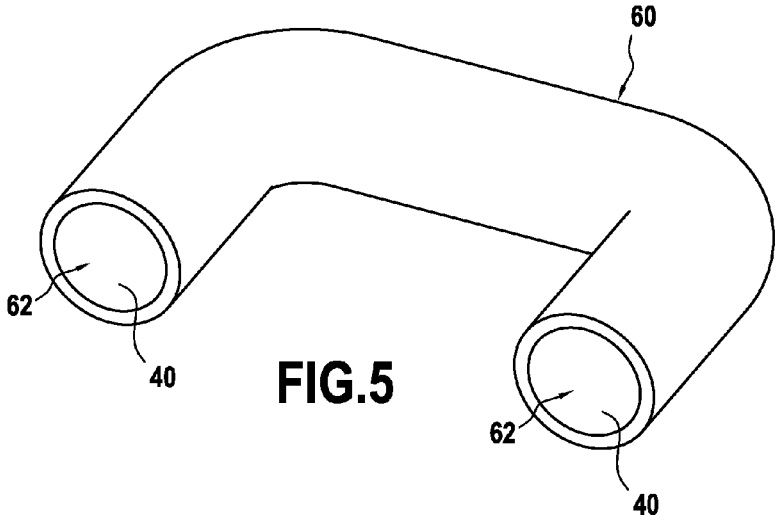
FIG. 5 is a perspective view of a hollow metal part obtained by casting in the mold of FIG. 4.

The hollow metal part 60 illustrated in FIG. 5 is thus obtained, the inner face of this part 60 being covered by the shell 40. The shell 40 is then destroyed and it is removed through the openings 62 to obtain the part 60 alone. For example, the shell 40 is destroyed by bead-blasting or by core removal using water under pressure (5 to 50 MPa) depending on the strength of the part 60.

By way of an example, it is possible to produce the part 60 by conventional die-casting of an aluminum-silicon-copper alloy. The injection pressure can vary from 100 bars to 1200 bars (i.e. 10 and 120 MPa), the flow speed of the metal can vary from 10 to 80 m/s. The proportion of silicon can range from 2 to 20%, the proportion of copper can range from 0.1 to 10%. If example, the Al Si 9 Cu 3 (Fe) alloy can be used.

The embodiments or implementation examples described in the present disclosure are given by way of illustration and without limitation, person skilled in the art being able to easily, in the light of this disclosure, modify these embodiments or examples or to conceive others, while still remaining within the scope of the invention.

Moreover, the different features of these embodiments or implementation examples can be used along or be combined. When they are combined, these features can be combined as described above or differently, the invention not being limited to the specific combinations describe in the present disclosure. In particular, unless otherwise stated, a feature described in connection with an embodiment or implementation example can be applied similarly to another embodiment or implementation example.

The invention claimed is:

1. A method for producing a hollow metal part by casting, wherein:

a destructible core is provided including a body made of aggregated materials, and a shell which surrounds said body and adheres thereto;

the core is positioned in a mold;

a metal is melted and liquid metal is injected into the mold, surrounding the core, the core embodying a space within the part;

after solidification of the part, the body is disaggregated and removed through removal openings provided in the shell and the part; and said shell is destroyed and removed through removal openings provided in the part; and wherein the destructible core includes, in addition, a framework which passes through the body of the core and is connected to the shell, and wherein said framework is destroyed and removed at the same times as the body and/or the shell wherein, to produce the core:

the body of the core is fabricated by aggregation of materials in a box equipped with pins passing through an interior of the box, so that the body, once extracted from the box, exhibits holes in place of the pins, and said holes are filled with a material constituting the framework, and wherein the body of the core is dipped in a first slurry to form the framework and a lower layer of the shell, and afterward in one or more slurries to form one or more upper layers of the shell.

2. The method according to claim 1, wherein the liquid metal is injected under pressure into the mold, surrounding the core, and wherein the shell exhibits sufficient mechanical strength to resist injection under pressure of the liquid metal.

3. The method according to claim 1, wherein the holes and the corresponding framework element pass all the way through the body of the core.

4. The method according to claim 1 wherein, to produce the core:

the body of the core is fabricated by aggregation of materials in a box equipped with support members passing through the interior of the box, and the shell surrounding the body and the support members is made such that the support members pass through the shell, and wherein the support members are used to hold the core in position in the mold during injection.

5. The method according to claim 4, wherein the support members are hollow and define exhaust passages for the gases formed by thermal decomposition of certain components of the core during casting of the part.

6. The method according to claim 5, wherein, after solidification of the part, the support members are extracted from the part to provide removal openings through which the body of the core and/or the shell are removed.

7. The method according to claim 4, wherein, after solidification of the part, the support members are extracted from the part to provide removal openings through which the body of the core and/or the shell are removed.

8. The method according to claim 1, wherein the body of the core is made of foundry sand or molding plaster.

9. The method of claim 8, where the body of the core is made of foundry sand or molding plaster with a fiber fill.

10. The method according to claim 1, wherein the shell of the core is made of ceramic.

11. The method according to claim 1, wherein the body is disaggregated and it is removed using a mechanical and/or hydraulic core-removal method.

* * * * *